United States Patent [19]

Kirn et al.

[11] 4,205,635

[45] Jun. 3, 1980

[54] FUEL MIXTURE CONTROL SYSTEM

[75] Inventors: Dieter Kirn, Heimsheim; Ulrich Steinbrenner, Stuttgart; Hans Schnürle, Walheim; Peter Werner, Stuttgart; Ulrich Drews, Vaihingen-Pulverdingen; Klaus Streit, Tübingen; Erwin Gloss, Korntal-Münchingen; Helmut Möder, Stuttgart, all of Fed. Rep. of Germany

[73] Assignee: Robert Bosch GmbH, Stuttgart, Fed. Rep. of Germany

[21] Appl. No.: 780,744

[22] Filed: Mar. 24, 1977

[30] Foreign Application Priority Data

Mar. 26, 1976 [DE] Fed. Rep. of Germany ..... 2612913

[51] Int. Cl.[2] ..... F02D 1/04

[52] U.S. Cl. ..... 123/32 EA; 123/179 L

[58] Field of Search ..... 123/32 EG, 32 EA, 179 L

[56] References Cited

U.S. PATENT DOCUMENTS

| | | | |
|---|---|---|---|
| Re. 29,060 | 12/1976 | Reddy | 123/32 EA |
| 3,199,293 | 8/1965 | Starkey | 123/32 EA |
| 3,533,381 | 10/1970 | Schmid et al. | 123/32 EA |
| 3,628,510 | 12/1971 | Moulds | 123/32 EG |
| 3,646,915 | 3/1972 | Rachel | 123/32 EG |
| 3,680,532 | 8/1972 | Omori | 123/32 EA |
| 3,792,693 | 2/1974 | Luchaco | 123/32 EG |
| 3,796,198 | 3/1974 | Mauch et al. | 123/32 EA |
| 3,796,199 | 3/1974 | Knapp | 123/32 EA |
| 3,812,830 | 5/1974 | Traisnel | 123/32 EG |
| 3,858,561 | 1/1975 | Aono | 123/32 EA |
| 4,046,129 | 9/1977 | Bigalike et al. | 123/32 EA |
| 4,069,795 | 1/1978 | Long et al. | 123/32 EG |
| 4,120,275 | 10/1978 | Isobe et al. | 123/179 L |

FOREIGN PATENT DOCUMENTS

| | | | |
|---|---|---|---|
| 2511974 | 9/1976 | Fed. Rep. of Germany | 123/32 EG |
| 2535918 | 3/1977 | Fed. Rep. of Germany | 123/32 EG |

*Primary Examiner*—Samuel W. Engle
*Assistant Examiner*—S. A. Cangialosi
*Attorney, Agent, or Firm*—Edwin E. Greigg

[57] ABSTRACT

A fuel mixture control apparatus for an electronic fuel injection system for internal combustion engines. In a warm-up controller, the fuel injection control pulses are lengthened for enrichment of the fuel-air mixture during engine warm-up on the basis of signals supplied by a temperature transducer. In order to make the warm-up enrichment dependent on prevailing engine states, for example on the conditions of idling and partial or full load, circuitry is provided to sense these conditions and to suitably alter the enrichment factor. A further circuit suppresses the dependence or enrichment on engine status during engine starting. Various embodiments are presented.

20 Claims, 6 Drawing Figures

FUEL MIXTURE CONTROL SYSTEM

BACKGROUND OF THE INVENTION

The invention relates to apparatus for the control of the fuel-air mixture of an internal combustion engine, in particular fuel enrichment during engine warm-up. The apparatus is further capable of switching over the fuel-air mixture control system on the basis of engine temperature and other operational conditions. The type of apparatus to which this invention particularly relates is an electronic fuel injection system wherein the injected fuel quantity per stroke is determined by circuitry containing an energy storage device, for example a capacitor, which is charged and discharged in controlled manner and thereby determines the duration of fuel injection control pulses. A temperature transducer is suitably provided in the vicinity of the engine, for example in the cooling system.

It is well known that the operation of internal combustion engines which are cold, i.e., which have not reached their normal operating temperature, requires a fuel-air mixture which is enriched in fuel, i.e., which contains more combustible fuel than is required for a stoichiometric mixture. Furthermore, the amount of fuel may exceed the power delivered by the engine during the warm-up phase.

The reason for having to supply excess fuel is that during and after the starting of a cold engine, a substantial fraction of the fuel supplied to the mixture condenses on the walls of the cylinders and the induction manifold and temporarily does not participate in the combustion process. Under certain circumstances, the raw fuel may in fact drain into the oil sump. Furthermore, a substantial amount of power is used for heating up the cold walls of the cylinder and the power lost to friction is also increased during the warm-up phase of operation.

Generally speaking, it may be said that the warm-up operation of an engine is defined by a multitude of factors and is a fairly complicated process which, furthermore, varies in each type of engine and for various manners of operation. Thus, the warm-up process must be so performed as to maintain smooth and reliable engine operation without causing the engine to jerk or stall, which implies that the control of the warm-up enrichment process, which may under certain circumstances require an enrichment as high as four times the normal amount of fuel, must take place in a very sensitive manner capable of adaptation to various conditions.

OBJECT AND SUMMARY OF THE INVENTION

It is a principal object of the invention to provide an apparatus for controlling the mixture enrichment phase of an internal combustion engine which is capable to so control the amount of fuel fed to an internal combustion engine during the warm-up phase and based on the temperature and operational state of the engine that, even for very low temperatures, the engine operates in a satisfactory manner and the prevailing limits for exhaust gas composition and air contamination are obeyed.

This and other objects are attained, according to the invention, by providing an apparatus based generally on that known in the art but improved in that a temperature-sensitive element, embodied as a temperature-dependent resistor, is provided within a control circuit which produces a variable output current to the circuit that defines the duration of the injection pulses. The discharge current for the capacitor that determines the injection pulse width is variable and the apparatus further contains a threshold circuit which changes the magnitude of the output current so as to produce a temperature-dependent function containing a knee which is used for controlling the fuel injection valves.

A major advantage of the apparatus according to the invention is that the basic circuitry of the electronic fuel injection system is not altered during the operation of the supplementary warm-up enrichment. The present circuit which is used for warm-up enrichment produces a careful and sensitively chosen output current based on temperature and operational state of the engine which is subtracted from the discharge current of a capacitor which itself defines the duration of the fuel injection pulses. In order to permit a very sensitive adaptation of the warm-up enrichment process, the threshold switch provides to the overall system a behavior following a function with a well defined knee, i.e., beginning with a certain temperature the warm-up function is made steeper, and the threshold at which the degree of steepness increases is derived from the same output signal of a sensor in the cooling system of the engine, for example an NTC resistor.

In a favorable embodiment of the invention, beginning at a certain temperature, a second resistor is connected in parallel with the temperature-dependent resistor for additional linearization and adaptation of the voltage across the NTC resistor. The NTC resistor controls a subsequent impedance converter, the output current of which is fed through suitable adjustable resistors to the circuit of an electronic fuel injection system which is responsible for defining the basic duration of the fuel injection control pulses. That circuit, which will be referred to below as a "multiplier circuit" is constructed as a monostable multivibrator having a timing capacitor in its feedback branch as will be explained in somewhat greater detail below.

The invention will be better understood as well as further objects and advantages thereof become more apparent from the ensuing detailed description of several exemplary embodiments taken in conjunction with the drawing.

DESCRIPTION OF THE PREFERRED EMBODIMENTS

Figure 1:
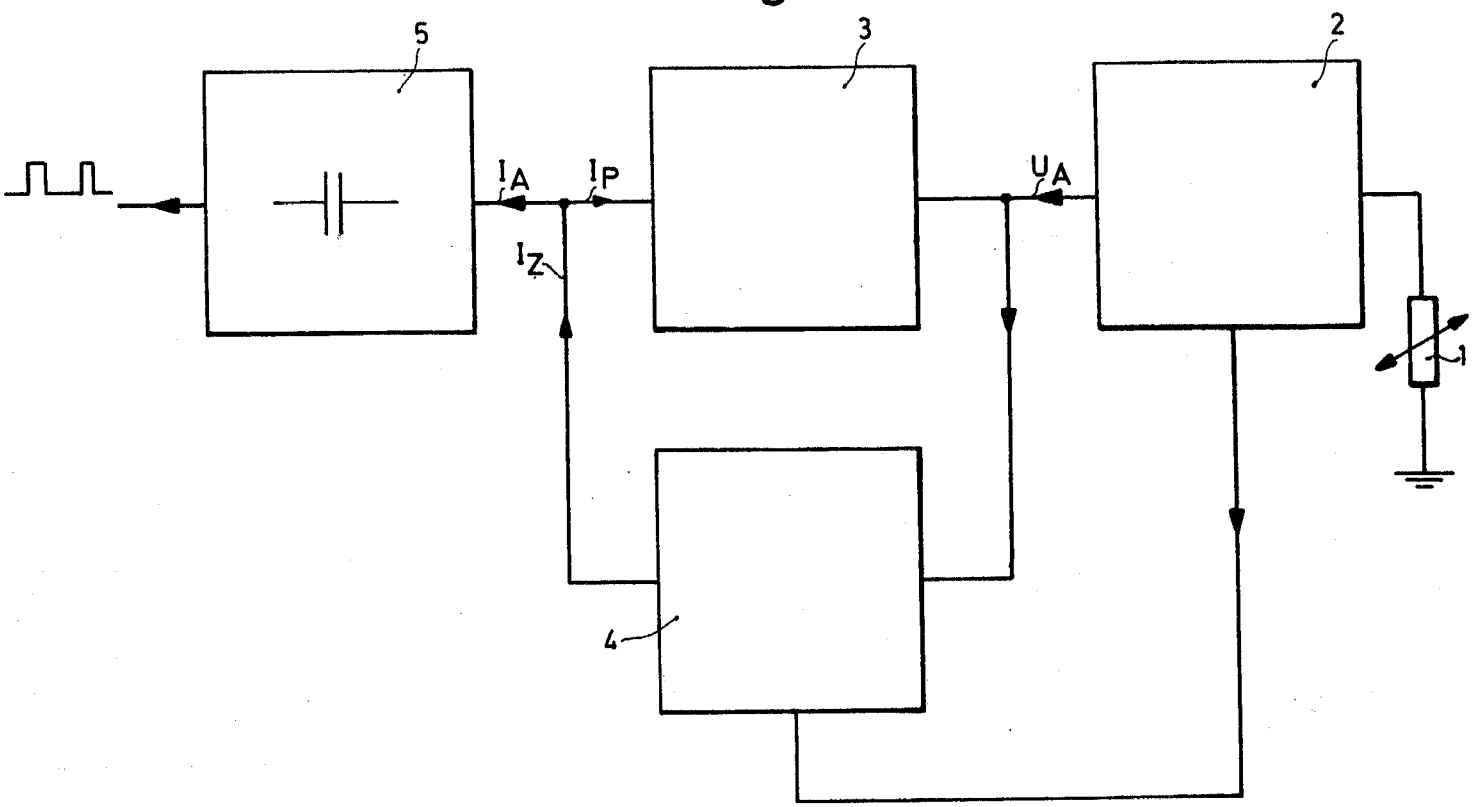
FIG. 1 is a block diagram of the basic apparatus of the invention.

Turning now to FIG. 1, there will be seen the major components of the apparatus of the invention arranged as blocks. All of these components are present in all of the exemplary embodiments described below, sometimes in slightly altered form. The first of these circuit elements is a temperature-dependent device, preferably an NTC resistor 1 located within the cooling system of the engine i.e., a resistor which changes its effective resistance inversely as a function of temperature, so that, for example, at very low temperatures, the resistance of the NTC resistor 1 would be relatively high. Further provided is a control circuit 2 which measures the resistance of the NTC resistor 1 and which delivers an output potential $U_A$ which is relatively insensitive to load and which is fed to a subsequent circuit 3 that produces a primary output current Ip. At the same time, the control circuit 2 supplies information regarding the prevailing temperature of the engine to a threshold circuit 4 which is so constructed as to be capable of adding an additional current $I_z$ to the primary current $I_p$ supplied by the circuit 3. The two currents when added constitute the output current $I_A$ which is supplied to a subsequent electronic fuel injection system and acts as the control current for the warm-up enrichment process. The block circuit diagram of FIG. 1 only shows that part of the fuel injection system which governs the duration of the fuel injection control pulses and it is labeled with the numeral 5. If the control circuit 2 generates an output voltage according to the temperature signal from the NTC resistor 1, and if this output potential is substantially insensitive to being loaded, then the threshold switch can also be so constructed as to be similar to a controlled resistor and be connected in parallel to the circuit 3 which produces the primary current which in the simplest case, could be a combination of resistors. Prior to discussing the individual detailed exemplary embodiments depicted in FIGS. 3, 4 and 5, which illustrate various examples of circuits used for warm-up enrichment, it would be useful to first discuss briefly the circuit portion 5 of the fuel injection system with the aid of FIG. 2, inasmuch as this circuit 5 is a part of all of the exemplary embodiments of the warm-up enrichment circuit.

It has already been mentioned that the circuit 5 is embodied as a control multivibrator circuit and includes a monostable multivibrator having a feedback capacitor. The time constant of the monostable multivibrator is defined by the recharging time of the capacitor which, in turn, is determined by the effect of a discharge current source and a charging current source which supply this capacitor with current. The discharging current provides a measure for the air flow rate in the engine and the charging current is related to the prevailing rpm of the engine, i.e., it is rpm-synchronous. If the discharging current of the capacitor is for example reduced, the time constant of the monostable multivibrator is correspondingly increased as is the length of the fuel injection control pulses, which results in the enrichment of the fuel-air mixture provided to the engine. The overall circuit according to the invention provides that the output current $I_A$ previously referred to is subtracted from the discharging current generated by the control multivibrator circuit, i.e., the larger the output current of the warm-up enrichment circuitry, the larger is the amount of fuel fed to the engine per power stroke inasmuch as a larger output current $I_A$ directly reduces the discharging current for the timing capacitor.

The timing capacitor in the circuit of FIG. 2 carries the reference numeral 6 and is connected between a charging current source 7, which need not be explained in greater detail, and a discharging current source which will be explained below. Line 7*a* and 7*b* connect the timing capacitor 6 with its associated monostable multivibrator so that it may determine the time constant of the latter in the customary manner. Inasmuch as the method of operation of monostable multivibrators is known, it will be further dealt with in the present context.

The output current $I_A$ is fed to the contact 8 whence it goes to the base of a transistor T29 which together with a transistor T30 forms an operational amplifier. The base of the transistor T30 receives a constant voltage from a voltage divider R43, R44. The emitters of the two transistors T29 and T30 are joined and are connected through a resistor R41 and via the collector emitter path of a transistor T31 and a further resistor R42 to the opposite source of polarity of the circuit, the latter being the negative line 9 in the present exemplary embodiment. The collector of the transistor T29 is connected through a resistor R40 to the positive supply line 10. The base of the transistor T31 receives a constant voltage via a divider chain consisting of the resistor R39 and two transistors T27 and T28. This part of the circuit performs the functions of a constant current source with respect to the current fed to the junction of the emitters of the transistors T29 and T30.

The output current $I_A$ from the warm-up enrichment circuit is fed to the transistor T29 causing it to conduct as long as the voltage at its base is sufficiently high. The transistor T29 then controls a subsequent transistor T34 causing it to conduct and raises the base of a further transistor T35 to which it is connected through a resistor R46 until that latter transistor also conducts. The emitter of the transistor T34 is connected directly to the positive supply line 10 and the entire circuit is so designed that the transistor T34 and the transistor T35 constitute a feedback branch of the operational amplifier. The transistor T35 receives the current $I_A$ present at the contact 8 of the circuit through its collector resistor R45 and the line 11. This current therefore does not flow into the transistor T29 as a base current but rather flows to the negative line 9 via the emitter resistor R47 of the transistor T35. The transistor T35 and an associated transistor T36 constitute a symmetric configuration in which the associated emitter resistors R47 and R48 are of identical value. Therefore, the current flowing through the collector emitter path of the transistor T36 and the resistor R48 is identical to the output control current $I_A$ from the warm-up enrichment circuit. The collector of the transistor T36 is connected to a circuit point P1 to which flows the discharge current $I_E$ from a control circuit associated with the fuel injection system, and not further described herein, and which is intended for the timing capacitor 6, coming through a resistor R60.

Further connected to the circuit point P1 is the collector of a transistor T38 which, together with an associated transistor T39, constitutes a combination similar to the combination of transistors T35 and T36. Thus the collector current of the transistor T38 is equal to the collector current of the transistor T39 which in turn is equal to the current flowing through the transistor T40 that constitutes the effective discharge current for the capacitor 6. On the other hand, however, the collector current of the transistor T38 is no longer equal to the original discharge current $I_E$ because the latter is reduced by the amount of the collector current of the transistor T36 and hence by the amount of the output control current $I_A$ of the warm-up enrichment circuit.

In the illustrated exemplary embodiment, the discharge current $I_E$ which is diminished by the prevailing output control current $I_A$ and which is equal to the current flowing through the collector emitter path of the transistor T40 due to the symmetrical construction of the transistors T38 and T39 flows through the subsequent series connection of the collector emitter path of a transistor T43 to the timing capacitor 6. The transistor T43 and a transistor T42 together constitute a Darlington circuit in which the base of the transistor T42 is coupled with the emitter of a further transistor T41, the collector and base of which are joined to the positive supply line 10. In this manner, the voltage loading of the transistors is divided up among several transistors.

The various embodiments of the current control circuits for producing the output control current $I_A$ which are illustrated in FIGS. 3–6 have the property of being capable of generating any desired broken curve representing the fuel quantity fed to the engine as a function of temperature so as to perform a sensitive process of warm-up enrichment. Furthermore, different types of behavior can be realized so as to be compatible with any specific operational state of the engine. In other words, the overall conception envisions that the fuel quantity fed to the engine during warm-up is not proportional to the temperature but rather can exhibit different rates depending on the instantaneous region of the temperature so that the function representing the fuel quantity versus temperature can have breaks in the slope and may even include discontinuities depending on the position of the gas pedal.

The curves which are associated with the control currents produced by the various circuits are shown in diagrams in those figures. These diagrams indicate the duration of the injection pulses $t_i$ (per power stroke) as a function of the temperature of the engine. Additional parameters which affect the position of these curves can be taken from the class including idling, labeled LL, full load, labeled VL and partial load, labeled TL. The circuits of FIGS. 3–6, which will be explained in detail below, permit a very sensitive generation and adjustment of such functions of the form $t_i=f(\theta)$, permitting adjustments to produce the most widely different functions. It is of particular significance that different enrichment factors are possible during warm-up for the various operational states of the engine, namely, idling, partial load and full load, so that, depending on the requirements and depending on the construction of the circuit, different enrichment factors may be chosen for these operational domains. For example, the idling state may be signalled to these circuits by a switch disposed at the throttle plate.

Figure 3:
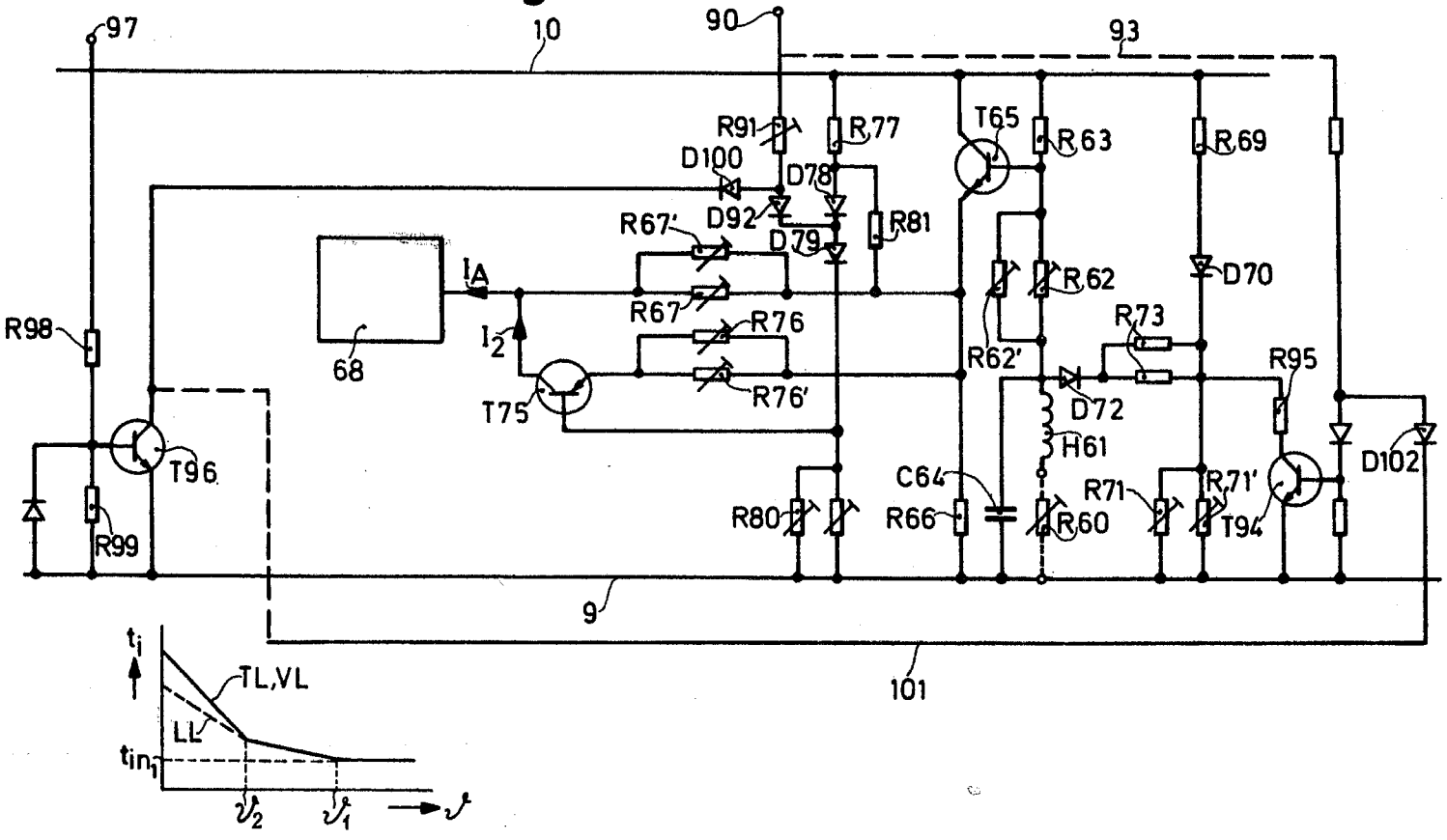
FIG. 3 is a first exemplary embodiment of a warm-up enrichment circuit according to the invention for producing a function with a knee.
Figure 4:
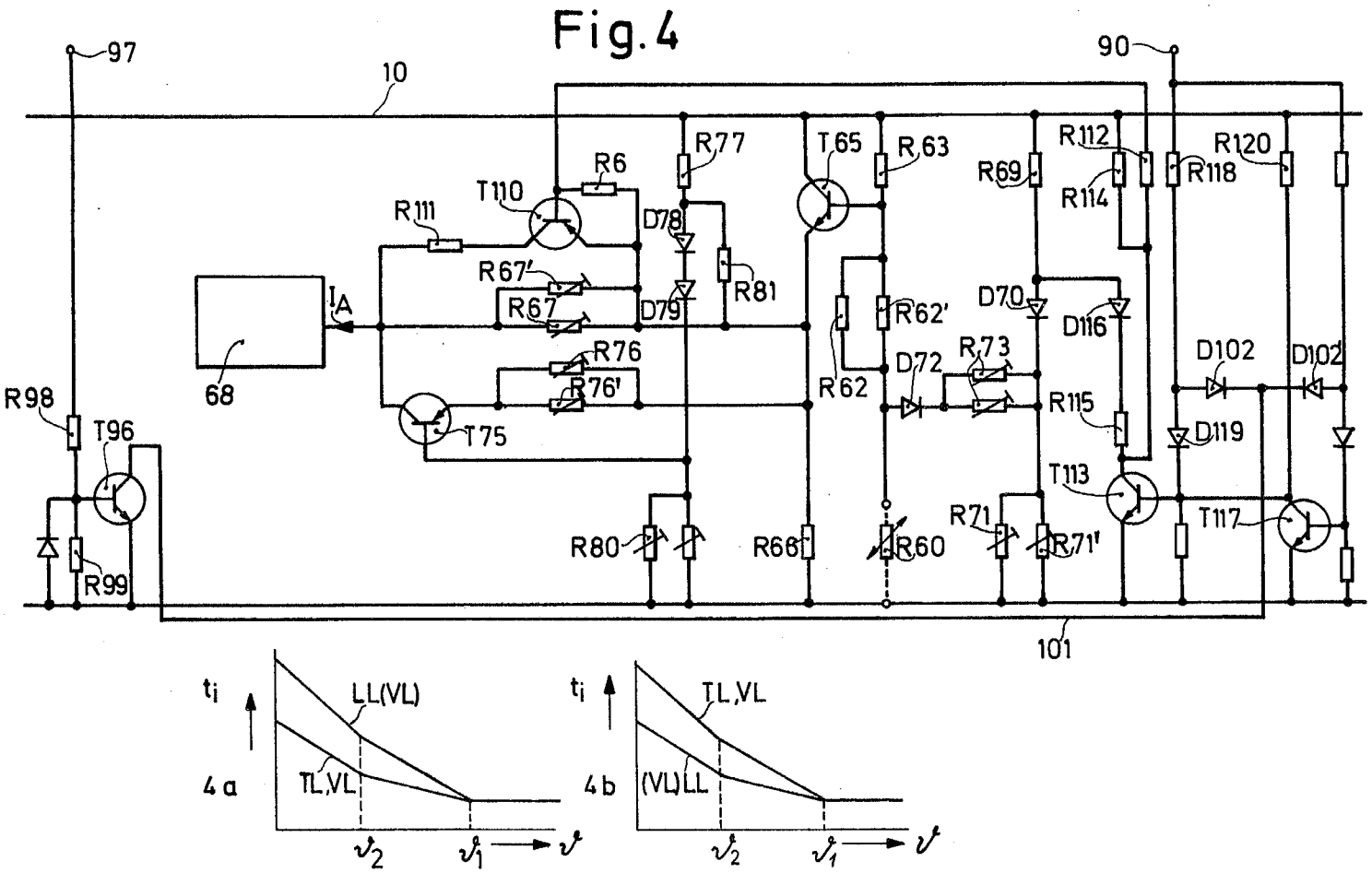
FIG. 4 is a second exemplary embodiment of a warm-up enrichment circuit producing a somewhat different switching behavior.
Figure 5:
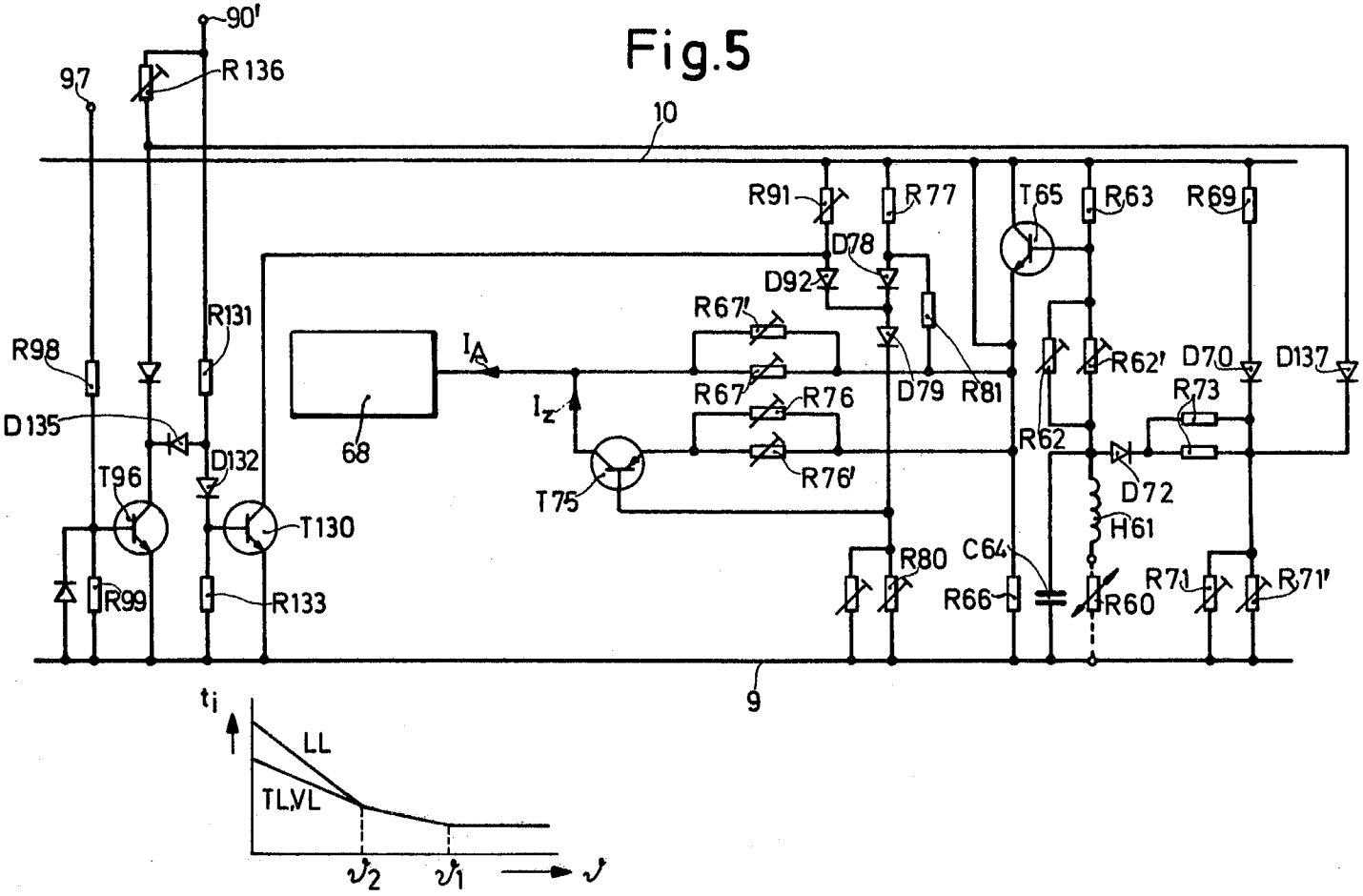
FIG. 5 is a third exemplary embodiment of the warm-up enrichment circuit.

The diagrams associated with the various circuits of FIGS. 3–6 show that the warm-up correction, i.e., the adaptation of the various processes to the prevailing engine state, may be made over the entire temperature range during warm-up as shown, for example, in the diagram of FIG. 4 or may only be effective during parts of the warm-up temperature range as shown in the diagrams of FIGS. 3 and 5. The functions themselves however are freely selectable.

In a particular embodiment of the invention, the whole system is so designed that the warm-up switchover is not effective during the process of engine starting so that the deliberate actuation of the gas pedal during starting, which is a common occurrence, does not result in different fuel parameters which would be dependent only on the individual engine operator. The small diagrams associated with the FIGS. 3–5 and which represent the bent functions related to the warm-up show that the fuel-air mixture is kept relatively lean by limited supply of fuel in the domain lying between 20° and 30° C. This is due to the requirements of exhaust gas rules whereas, at lower temperatures, a steeper function, i.e., a greater amount of enrichment is required.

However, the enlarged enrichment which permits smooth transitions may be too rich during idling so that the circuits which will be further described also contain provisions that at least two different warm-up functions may be chosen in dependence on a throttle plate switch. The factors which determine this choice are:

1. The temperature of the engine (either cooling medium or cylinder head temperatures).

2. The position of the idling contact associated with the thottle switch.

The possibility of providing different warm-up enrichment processes for idling, partial load or full load, thereby permitting a sensitive adaptation to the engine type and the engine status, makes it possible to substantially improve the composition of the exhaust gas and to improve the manner of performance even during the critical warm-up of the engine.

Figure 2:
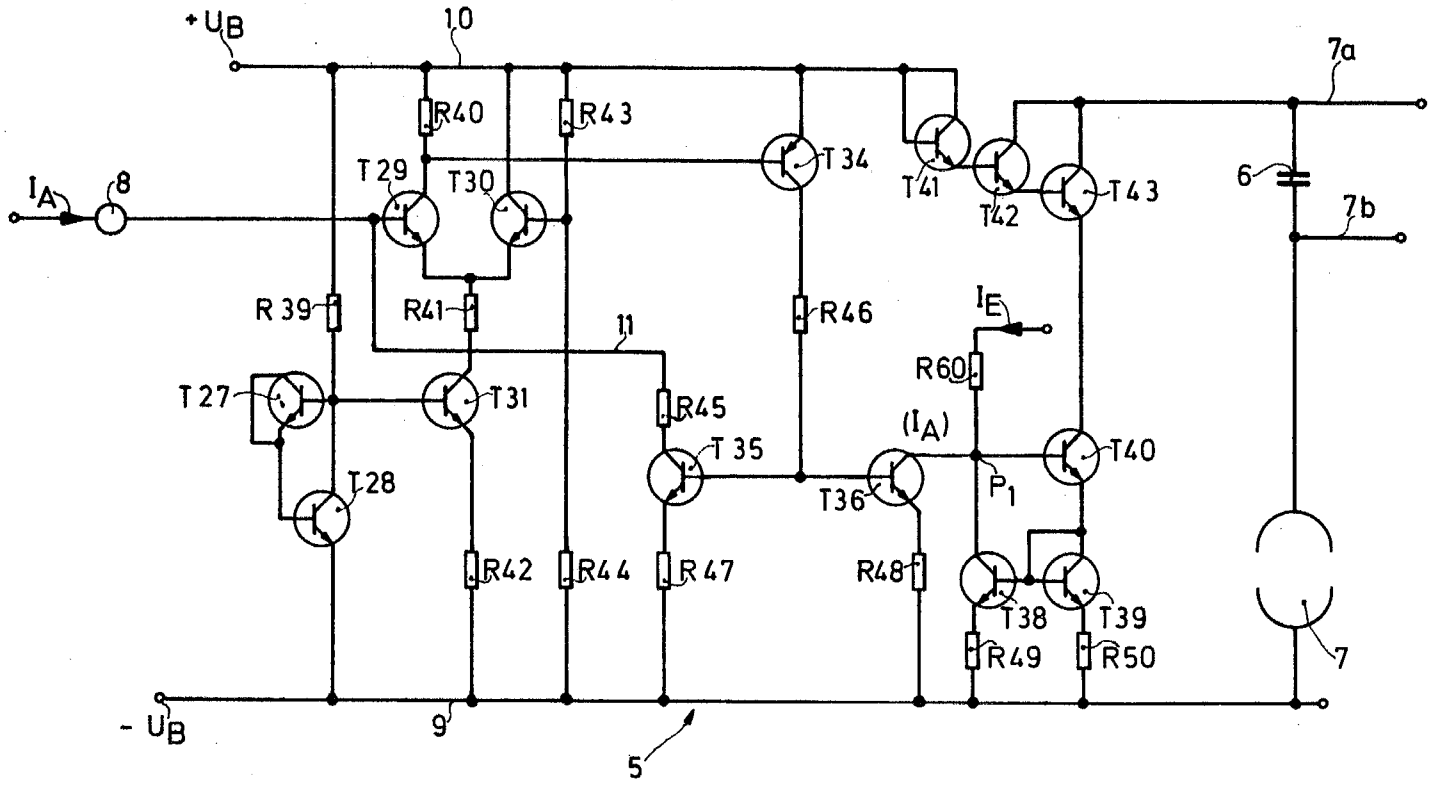
FIG. 2 is a detailed circuit diagram of that part of the circuit of an electronic fuel injection system which receives the temperature-dependent output control current of the warm-up enrichment circuit of the invention.

It has already been said that the magnitude of the output current $I_A$ which is produced by the warm-up enrichment circuit is fed to the partial circuitry shown in FIG. 2 for generating the fuel injection pulses. In what follows there will now be given a detailed explanation of the manner of generating this output control current $I_A$ for producing the various bent functions related to the warm-up phase. In the exemplary embodiment of FIG. 3, the temperature-dependent element is an NTC resistor R60. This resistor R60 is connected in series with a coil H61 and two series resistors R62 and R63, the entire chain being connected between the positive line 10 and the negative line 9. The coil H61 serves for the decoupling of any high frequency disturbances as does a parallel capacitor C64. The resistor R62 is made adjustable and may be supplemented by a further parallel resistor R62'. The behavior of the NTC resistor is such as to exhibit a high resistance for low temperatures. Its effect is sensed at the junction of the two resistors R63 and R62 by the base of a transistor T65, connected as an emitter follower, which produces a loadable voltage proportional to the temperature behavior of the resistor R60 at its emitter resistor R66. The function of the transistor T65 is substantially that of an impedance converter. The voltage at the emitter of the transistor T65 will be more positive the lower the temperature of the engine. This is equivalent to a high resistance of the resistor R60 which implies that the current $I_A$ which flows through the adjustable resistors R67 and R67' to the multiplier circuit 68 (corresponding to the circuit 5 of FIG. 2) is proportional to the resistance of the resistor R60 within a certain temperature range as will be further discussed below.

However, this current cannot flow at all unless the threshold potential at the output of the transistor T65 is exceeded and this threshold potential is determined by the voltage fed to the second input of the operational amplifier T29, which was already discussed in relation to the illustration of FIG. 2. This voltage is determined by the magnitudes of the resistors R43 and R44; furthermore the threshold depends substantially on the adjustment of the resistors R62 and R62'. As soon as the threshold of the multiplier circuit 68, which incidentally would be embodied as an integrated circuit, is exceeded, the current may flow. In relation to the diagram of FIG. 3, this means that a control current $I_A$ flows beginning at and below the limiting temperature $\theta_1$. A temperature above $\theta_1$ as indicated by the NTC resistor R60 does not cause a warm-up enrichment, i.e., the duration of the fuel injection control pulse fed to the engine is equal to the normalized control pulse $t_iN$ which has the normalized value 1. While the threshold is determined by the resistances R43 and R44 of FIG. 2, and those of R62 and R63 of FIG. 3, the magnitude of the current is set by the adjustment of the resistors R67, R67'. Inasmuch as the resistor R60 may assume very high values of resistance at low temperatures, which means that the base of the transistor T65 is practically at the potential of the positive supply line, there is connected in parallel to the resistor R60, and beginning at a certain voltage, a further resistance, and the voltage at which this further resistance is connected in parallel is defined by the series connection of the resistor R69, the diode D70 and the resistors R71 and R71', both of which are adjustable. The connection of the resistors R71, R71' to the junction point of the coil H61, i.e., generally to the NTC resistor, takes place through the series-connected diode D72 which conducts beginning with a certain voltage present at its anode and a resistor R73 which, as is often the case in the present circuit, consists of two adjustable single resistors for the purpose of a better adjustment. In this manner, the output control current $I_A$ is limited for very low temperatures.

When the engine has a low temperature, the proportional relationship of the warm-up enrichment function to temperature is exchanged, for temperatures lying between $\theta_2$ and $\theta_1$, by a steeper curve which is generated by an additional current $I_Z$ beginning at that temperature. In the exemplary embodiment illustrated, the temperature $\theta_1$ may be, for example, 30° C. and above this temperature no enrichment takes place; between 20° C. equal to $\theta_2$ and 30° C., the warm-up enrichment function is such as to provide a relatively lean mixture, whereas below $\theta_2$, i.e., below 20° C. the function has a steeper slope indicated by the continuous line. The behavior in this region is provided by a transistor T75 whose emitter collector path causes further adjustable resistors R76 and R76' to be connected in parallel to the resistors R67 and R67' as soon as the engine temperature falls below $\theta_2$. For this purpose, the base of the transistor T75 is connected to the junction of a voltage divider consisting of the series connection of a resistor R77, diodes D78 and D79 and a resistor R80 which is adjustable and may also be composed of two parallel resistors. The voltages present between the base and the emitter of the transistor T75, that emitter being connected through resistors R76 and R76' to the emitter of the transistor T65, the potential of the latter being changeable by means of the NTC resistor, determine the turn-on point of the additional current $I_Z$ which defines the increase in the steepness of the slope of the warm-up enrichment function. If necessary, this voltage divider, which controls the base voltage of the transistor T75 via a resistor R81, could also be connected to the output voltage of the transistor T65. It will be appreciated that the onset point of the increased slope of the function is determined by the magnitude of the resistor R80 whereas the adjustment of the resistors R76, R76' defines the magnitude of the additional current supplied. It has already been mentioned that some vehicles require an additional adjustment of the warm-up enrichment function for the various domains of operation, in particular idling, partial load or full load. In order to provide this changeable enrichment function, the base of the transistor T75 receives a more positive voltage during the idling of the engine so that the transistor T75 is moved further into its cut-off region and the additional current $I_Z$ supplied thereby diminishes. Thus, during idling, the enrichment is lower than during full load as is indicated by the dashed portion of the curve of the diagram. This purpose is achieved, as already discussed, by an idling switch associated, for example, with the throttle plate of the engine, which supplies a more positive voltage to the contact 90 during idling.

Another possible embodiment is to feed a positive voltage to the base of a transistor T94 through a line 93, thereby causing it to conduct and to place an adjustable resistor R95 in parallel to the resistors R71 and R71'. In that case, the voltage fed to the base of the transistor T65 from the NTC resistor may be deliberately lowered so that the same purpose is served as before with the difference that the control takes place directly by changing the characteristic of the NTC resistor.

Finally, the circuit of FIG. 3 exhibits a transistor T96 which is controlled by a positive voltage fed to an input contact 97 whenever the engine is being started, thereby causing a current flow through the series connection of resistors R98 and R99. When the engine is being started, this transistor T96 conducts and carries the voltage at the input contact 90 (which corresponds to idling or full load position of the gas pedal) through a diode D100 to ground or the negative line 9. In other words, the switchover of the broken function from one curve to the other, depending on operational states of the engine, is suppressed during engine starting so that any discretionary actuation of the gas pedal does not cause this function to alter.

In the alternative construction, wherein the switchover takes place via the transistor T94, the signal is taken from the collector of the transistor T96 through a line 101, shown partly dashed, and a diode 102 to the base of the transistor T94, thereby causing a positive potential to be grounded and maintaining the transistor T94 in its blocking condition. Thus the circuit according to FIG. 3 is capable of producing the type of warm-up function depicted in the associated diagram, including the bent portion, and the supplementary switchover from one function to the other depending on the operational state of the engine.

The second embodiment of the warm-up enrichment circuit as illustrated in FIG. 4 permits, as indicated in the two associated diagrams, to select a different type of enrichment from the very beginning depending on the load condition of the engine, namely, idling or partial and full load. A number of elements in the circuit according to FIG. 4 is identical to that of FIG. 3 and those elements will have identical reference numerals. A difference with respect to FIG. 3 is that the positive voltage of the closed idling switch fed to the contact 90 no longer affects the switching of the transistor T75 because that transistor is connected to potentials which are shifted only by the changing resistance of the NTC resistor R60 due to temperature changes so that the onset of the function at $\theta_2$ no longer depends on the position of the LL or VL switch. The switchover to the prevailing engine condition in the exemplary embodiment of FIG. 4 is performed by a supplementary transistor T110 whose emitter collector path lies in series with an adjustable resistor R111 both of which are in parallel with the resistors R67, R67'. The base of the transistor T110 is connected through a resistor R112 to sense the collector voltage of a switching transistor T113, the base of which receives the voltage applied to the contact 90 by the idling switch. As long as the transistor T113 blocks due to the absence of a positive voltage at its base, the base of the transistor T110 is rendered positive through a resistor T114 and is thus also blocked. It will be appreciated that this connection permits the generation of the function according to the diagram 4a, i.e., when the idling switch is closed, a supplementary current through the transistor T110 is provided over the entire warm-up domain with the result that the function splits into two branches depending on the operational state of the engine below the temperature $\theta_1$. At the same time, the entire warm-up enrichment domain is damped during the idling condition of the engine because of the connection of the collector of the transistor T113 to the junction of the resistor R69 and the diode D70 and by means of the series connection of an adjustable resistor R115 and a diode D116.

On the other hand, in certain engine types, the operational domain corresponding to partial or full load requires a higher enrichment and, for this reason, the circuit according to FIG. 4 includes a simple inverter circuit consisting of a transistor T117 connected ahead of the transistor T113 whose base is controlled directly by the contact 90 but, in this case, by the actuation of a full load or partial load switch which also supplies a positive potential to the contact 90. In that case, the resistor R118 and the diode D119 in the base control circuit of the transistor T113 are eliminated as is the diode D102 which, as already explained, suppresses the effect of the transistor T113. The control of the transistor T113 then takes place only through the collector resistor R120 of the transistor T117, thereby achieving an inversion of the LL curves and the TL(VL) curves in the two diagrams of FIGS. 4a and 4b respectively.

In a third exemplary embodiment of the warm-up enrichment circuit illustrated in FIG. 5, the switchover of the enrichment factor is inverted with respect to the embodiment of FIG. 3, i.e., the engine receives a richer mixture during idling at relatively low temperatures which lie below the temperature $\theta_2$. For this purpose, the junction of the diodes D78 and D79 is no longer connected selectively with positive potential from the contact 90 via the diode D92 and the adjustable resistor R91, rather it is permanently connected to the positive supply line 10 so that, when the idling switch is open for example, i.e., during full load or partial load, the engine is supplied with a lean mixture as indicated in the diagram associated with FIG. 5. If the contact 90' receives a positive voltage, the transistor T130 is rendered conducting through the series connection of resistor R131, the diode D132 and the resistor R133, thereby blocking the diode D92 which is connected to ground 9 through the collector emitter path of the transistor T130. Thus, the curves for partial and full load split at this point because the transistor T75 is conducting to a higher degree and the additional current for idling is increased. At the same time, when the engine is being started, the transistor T96 disengages this process so as to attain an independence of the fuel control function from the instantaneous position of the gas pedal. For this purpose, the junction of the resistor R131 and the diode D132 is connected through a diode D135 and the collector emitter path of the transistor T96 to ground during starting. In addition, the positive voltage present at the contact 90' is carried through an adjustable resistor R136 and diode D137 to the damping elements, thereby causing a reduction of the damping during idling, through the diode D72.

It will be appreciated that the various embodiments of the warm-up enrichment circuits of FIGS. 3, 4 and 5 permit a generation of the largest variety of curves, including bent curves, and permits possibilities to switch from one function to another as illustrated in the splitting of the enrichment curves. In addition, the closure of an idling switch which places a positive voltage on the contact 90 may be replaced by the closure of a full load switch, in which case the terms idling and full load would be reversed in the illustrated curves as is indicated by the terms in parentheses in the various diagrams.

Figure 6:
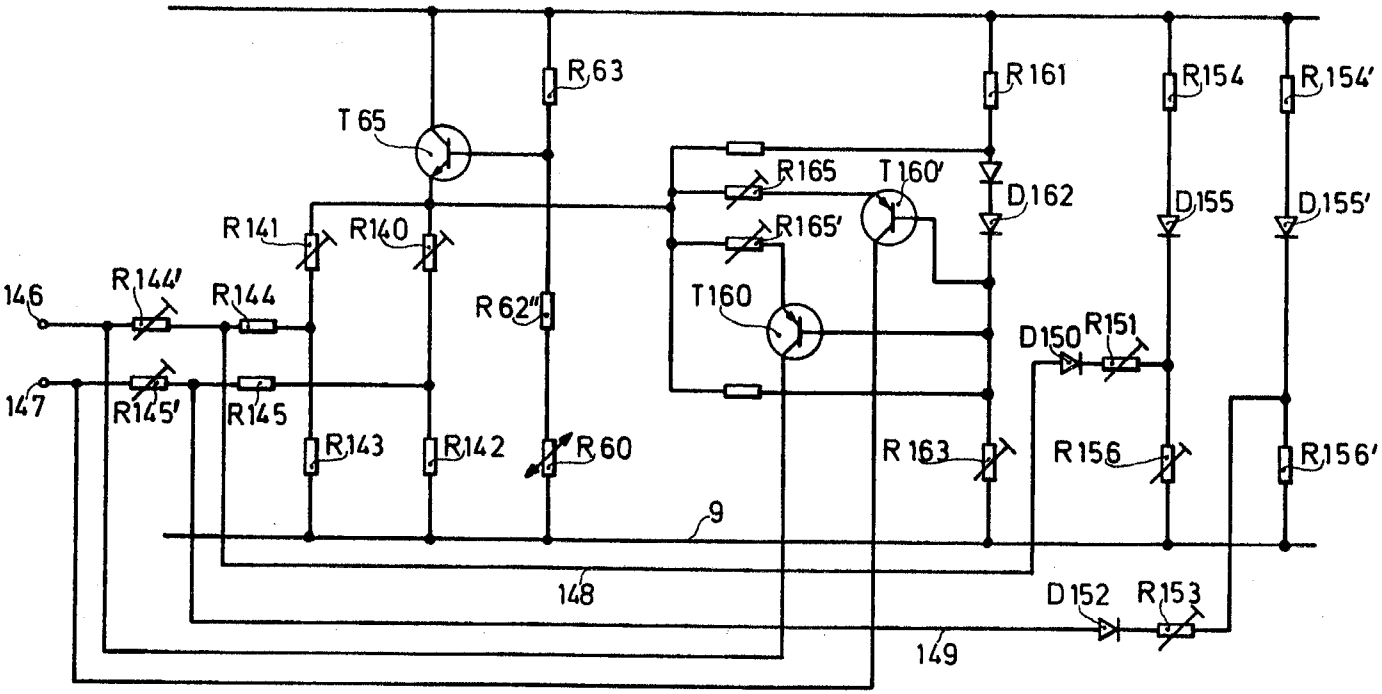
FIG. 6 is a circuit diagram of a warm-up enrichment circuit for use in internal combustion engines, for example 8-cylinder V-type engines, wherein there is provided a separate warm-up circuit for each bank of cylinders.

Finally, FIG. 6 illustrates a solution of the problem of the warm-up enrichment circuit in engines in which only a portion of the engine cylinders is connected to the same electronic fuel injection system as for example in engines of the V-8 type. In such engines, it is sometimes desirable to control the two cylinder banks separately and to control their warm-up separately because it is possible that the two cylinder banks are subject to different operational conditions, for example temperature. Thus the circuit of FIG. 6 again includes the NTC resistor R60 in series with a resistor R62" and a resistor R63, but in this case, the threshold adjustment does not take place in this series connection but separately for the two domains to be controlled, in the emitter circuit of the transistor T65. To this end, the emitter of the transistor T65 is connected via separately adjustable resistors R140 and R141 and series resistors R142 and R143, respectively, to the minus line 9, and the junction of these resistors is connected, in the first instance, to the series connection of the resistors R144 and R144' and, in the other case, with the series connection of a resistor R145 and an adjustable resistor R145'. The free electrodes of these latter resistors provide output voltages at contacts 146 and 147, respectively, which may be further processed if desired in accordance with the provisions of the circuitry of FIGS. 3–5 and might correspond, for example, to the emitter contacts of the transistor T65 in those circuits so that two different output control currents $I_A'$ can be generated for the two different banks of cylinders. Furthermore, the junction points of the resistors R144 and R144' as well as R145 and R145' are connected through lines 148 and 149, respectively, which contain, respectively, the series connections of a diode D150 and adjustable resistor R151 or a diode D152 with an adjustable resistor R153 to the junction points of voltage divider circuits which are connected across the voltage supply lines and consist, respectively, of the series connections of a resistor R154, a diode D155 and an adjustable resistor R156 and, in the other branch, of a resistor R154', a diode D155' and an adjustable resistor R156', all connected to ground. The resistors R140 and R141 serve to set the threshold of the warm-up enrichment circuits, i.e., an adjustment of these resistors defines the temperature at which the warm-up enrichment takes place separately at the two cylinder banks, and the adjustable resistors R144 and R145, R144' and R145' serve to adjust the slope of the curves during warm-up. Furthermore, each of the enrichment circuits may have its own damping obtained through the series connections of resistor R154, diode D155 and resistor R156 on the one hand, and resistor R154', diode D155' and resistors R156' on the other hand which, together with the adjustable resistors R151 and R153, define the voltage at the junction of the resistors R144 and R144' and at the junction of resistors R145 and R145'. This means that the damping may be selectively adjusted and does not affect the NTC resistor R60 directly. Finally, the circuit of FIG. 6 includes transistors T160 and T160' controlled by the same voltage from a voltage divider circuit consisting of a resistor R161, a diode D162 and an adjustable resistor R163. The transistors T160 and T160' are in series, respectively, with adjustable resistors R165 and R165' and lie in parallel with the emitter of the transistor T65 and the prevailing output contact 146 or 147. Thus, these transistors correspond in operation approximately to that of the transistor T75 of the circuits previously described, i.e., the adjustment of the resistors R165 and R165' selects the slope of the function in a region of a supplementary increase of the enrichment in the warm-up enrichment curve, whereas the threshold, i.e., the point at which the break in the enrichment curve takes place, is set by adjusting the resistor R163 together for both units.

The foregoing relates to preferred exemplary embodiments of the invention, it being understood that other embodiments and variants thereof are possible within the spirit and scope of the invention.

What is claimed is:

1. In an apparatus for mixture control of an internal combustion engine, said apparatus including a main pulse control circuit for generating variable fuel injection control pulses on the basis of engine speed and air flow, said main pulse control circuit including an energy storage component the charging and discharging of which determines the length of said fuel injection control pulses, said apparatus further including warmup control means for changing the amount of fuel injected on the basis of engine temperature, the improvement comprising:

(a) a first control circuit including a temperature-dependent sensor, for generating a primary partial current whose magnitude varies with engine temperature; said primary partial current being applied to an input of said main pulse control circuit;

(b) a second, auxiliary, control circuit connected to receive a temperature signal from said first control circuit, for generating a supplementary control current which is also applied to said input of said main pulse control circuit, thereby increasing the fuel supplied to the engine; and (c) a switching circuit, connected to receive a signal related to engine operation and designating idling, partial load and full load, said switching circuit being connected to at least one of said first and second control circuits; whereby different operational states of the engine result in different temperature dependences of the fuel supply for the engine.

2. A method for controlling the temperature dependence of the fuel mixture supplied to an engine during warmup, wherein the engine temperature is detected by a temperature sensor and the fuel quantity is increased over a nominal amount which is being supplied on the basis of engine speed as aspirated air flow and wherein the improvement comprises the steps of:

(a) In a first temperature range, supplying an additional amount of fuel over the nominal amount in proportion to the measured engine temperature;

(b) In a second temperature range, increasing the additional amount of fuel beyond the proportionality obtaining in said first temperature range, to provide additional fuel enrichment is said second temperature range; whereby the overall curve which defines fuel supply vs. temperature is bent and composed of connecting linear segments; and (c) changing the slope of at least one of said linear segments in said curve in dependence on engine variables other than temperature (idling, partial load, full load).

3. An apparatus as defined by claim 2, wherein said pulse control circuit includes an operational amplifier, one input of which receives the sum of said primary control current and said supplementary control current and further includes a voltage divider connected to the other input of said operational amplifier for aiding in the determination of the onset of the enrichment factor during engine warm-up.

4. An apparatus as defined by claim 3, the improvement further comprising a transistor (T34) connected to the output of said operational amplifier controlling two symmetric transistors (T35, T36) such that the same current flows in both of said transistors (T35, T36), one of said transistors (T35) being connected from its collector to the input of said operational amplifier; whereby the total control current composed of the sum of said primary and said supplementary control current passes over the collector emitter path of said transistor (T36).

5. An apparatus as defined by claim 4, further comprising a transistor (T38) and a further transistor (T39) connected symmetrically to carry a current of equal magnitude, the collector of said transistor (T38) being connected to the collector of said transistor (T36), and further including a transistor (T40) the emitter of which is connected to the collector of said transistor (T39) and the collector of which is connected to the emitter of a further transistor (T43), the collector of which is connected to a capacitor which is said energy storage component.

6. An apparatus as defined by claim 2, wherein said temperature sensitive component is a resistor (R60) connected in series with an adjustable resistor (R62) and a further resistor (R63) and further comprising an impedance converting transistor (T65) the emitter of which is connected via an adjustable resistor (R67) to the input of an operational amplifier consisting of transistors (T29,T30); whereby for a given temperature range, the magnitude of the total control current which is the sum of said primary and said supplementary control currents is determined by said resistor (R67) and wherein the threshold at which warm-up enrichment begins is determined by the adjustable resistor (R62) in the base circuit of said transistor (T65).

7. An apparatus as defined by claim 6, wherein there is connected in parallel to said resistor (R67) in the emitter circuit of said impedance converter transistor (T65) a further transistor (T75) connected in series with adjustable resistors (R76, R76'), the base of said transistor (T75) being biased by an adjustable voltage divider circuit; whereby beginning with a lower temperature, a supplementary current may be supplied to the input of said operational amplifier for increasing the amount of fuel fed to the engine per operational cycle thereof.

8. An apparatus as defined by claim 7, further comprising means for transducing the engine states idling and full load and for supplying a signal related thereto to the base of said transistor (T75) via said adjustable voltage divider circuit.

9. An apparatus as defined by claim 8, wherein said means for supplying a signal related to engine status is a switch providing a positive signal when closed which is connected through a resistor (R91) and a diode (D92) to the junction of two diodes (D78, D79) which are part of said voltage divider circuit.

10. An apparatus as defined by claim 9, further comprising a transistor (T96) so connected as to carry to ground said signal related to engine status and so connected as to conduct when the engine is being started.

11. An apparatus as defined by claim 10, further comprising resistor means (R71) connected to be switched in parallel with said temperature-sensitive resistor; whereby the temperature behavior of said temperature-sensitive resistor (R60) may be changed at low temperatures.

12. An apparatus as defined by claim 11, wherein said resistor means (R71,R71') is part of a voltage divider circuit further including a resistor (R69) and a diode (D70) connected through a diode (D72) with said temperature-dependent resistor.

13. An apparatus as defined by claim 12, further comprising a transistor (T94) the emitter collector path of which is connected in parallel to said additional resistor means (R71,R71').

14. An apparatus as defined by claim 12, wherein the base of said transistor (T75) is connected to a voltage divider circuit and further comprising a transistor (T110) connected in parallel with said transistor (T75) and controlled by said signal related to engine status; whereby the enrichment behavior of said apparatus may be controlled in dependence on operational engine states.

15. An apparatus as defined by claim 14, further comprising a transistor (T113) controlled by said signal related to engine status and connected to the base of said transistor (T110).

16. An apparatus as defined by claim 15, further comprising an inverter transistor (T117) controlled by said signal related to engine status and further connected to control said transistor (T113).

17. An apparatus as defined in claim 16, further comprising means generating a signal related to idling and to full load, and means for connecting said signal selectively to said warm-up circuit; whereby the amount of fuel fed to the engine may be adapted to the requirements of the status thereof.

18. An apparatus as defined in claim 2, wherein said temperature-dependent resistor (R60) is connected in series with an adjustable resistor (R62) and a further resistor (R63) and wherein there is further comprised an impedance converting transistor (T65) the emitter of which is connected through an adjustable resistor means (R67,R67') to the input of an operational amplifier consisting of transistors (T29,T30), and wherein the emitter circuit of said transistor (T65) includes the collector emitter path of a further transistor (T75) connected in series with adjustable resistor means (R76,R76') the base of said transistor (T75) being connected to a voltage divider circuit and further comprising a transistor (T130) controlled by signals related to idling of the engine and connected to ground for grounding out a supplementary bias voltage of said transistor (T75) whereby the transistor (T75) carries said supplementary control current.

19. An apparatus as defined by claim 2, wherein said temperature-sensitive component is a temperature-dependent resistor (R60) connected in series with two resistors (R62", R63), coupled to an impedance converting transistor (T65), and including separate and separately adjustable output resistor means for at least two separate circuits connected to the emitter of said transistor (T65), and two separate voltage divider circuits associated with said separate emitter circuits for providing selective operation of said emitter circuits.

20. An apparatus as defined by claim 19, wherein the emitter circuit of said impedance converting transistor (T65) includes two separate transistors (T160 and T160') controlled by a common adjustable voltage divider circuit composed of a resistor (R161), a diode (D162) and a resistor (R163) and including adjustable emitter resistors (R165' and R165).

* * * * *